United States Patent [19]

Oldfield

[11] Patent Number: 4,535,495

[45] Date of Patent: Aug. 20, 1985

[54] BACK REST CUSHION

[75] Inventor: Peter M. Oldfield, Sausalito, Calif.

[73] Assignee: Easy Ride, Inc., San Mateo, Calif.

[21] Appl. No.: 517,076

[22] Filed: Jul. 25, 1983

[51] Int. Cl.[3] ..... A47C 7/02

[52] U.S. Cl. ..... 5/432; 5/436; 5/71; 297/460

[58] Field of Search ..... 5/431, 432, 436, 433, 5/71, 72; 297/284, 453, 460

[56] References Cited

U.S. PATENT DOCUMENTS

| | | | |
|---|---|---|---|
| 1,567,695 | 12/1925 | Angell | 297/460 |
| 2,970,638 | 2/1961 | Halter | 297/460 |
| 3,361,471 | 1/1968 | Radford | 297/460 |
| 3,716,270 | 2/1973 | Frazier | 297/460 |
| 4,383,342 | 5/1983 | Forster | 5/432 |

FOREIGN PATENT DOCUMENTS

| | | | |
|---|---|---|---|
| 957440 | 11/1974 | Canada . | |
| 1023483 | 12/1977 | Canada | 5/432 |
| 1590583 | 6/1981 | United Kingdom . | |

*Primary Examiner*—Gary L. Smith
*Assistant Examiner*—Michael F. Trettel
*Attorney, Agent, or Firm*—Thomas M. Freiberger

[57] ABSTRACT

A back rest cushion constituting a therapeutic pad of resilient material is formed with a curving front surface to support the full length of the spine. The cushion is cut away at its upper corners to give freedom of movement to the scapulae.

6 Claims, 4 Drawing Figures

BACK REST CUSHION

BACKGROUND OF THE INVENTION

The present invention relates to back rest cushions, and, more particularly, to a therapeutic pad designed to supplement the supporting action of the backs of seats or chairs and the like by providing positive cushioned support to the user's full back, yet allowing free movement of the shoulder blades and arms, and turning of the upper torso, during employment. This invention has particular application to vehicle seats and to the prevention and the easing of neuromuscular fatigue and pain, regardless of the pitch or angle of the chair or seat to which such support is supplied, during extended periods of use.

It is well known, especially when traveling for example by automobile, that fatigue can occur due to lack of anatomically correct support to the back of the person seated, especially when the person remains seated for prolonged periods of time. The general tendency at such a time is for the body to sag or to be otherwise positioned in such a manner as to cause discomfort and even pain due to the resultant neuromuscular aggravation. Improper positioning can also result in the undesired tightening of muscles, the partial functional impairment of blood circulation and/or of the internal organs, and hampered breathing. All or some of said physical effects can concomitantly contribute to mental fatigue and thereby increase hazard to vehicle driver and passengers.

DISCUSSION OF PRIOR ART

Various attempts have been made to overcome the foregoing difficulties by the use of back rest pads having a protrusion thereon for applying pressure directed inwardly of the back adjacent the lumbar region. Such prior cushions have been found to be unsatisfactory in giving the kind of pressure to the body which provides the greatest relief and proper positioning, or to fail to support additionally the lower and/or upper back. Some prior designs provide support to the full length of the back, but, when in contact with the back, do not allow free movement of the shoulder blades and arms, and do not provide for turning of the upper torso during employment. No prior cushions of which I am aware provide both support and protection to the coccyx while simultaneously preventing its lateral movement. The prior cushions are minimally adaptable to persons of varied heights, or are required to be manufactured in varying sizes to accommodate such variations in body size. Many of the prior support devices provide cushioning where the resiliency gives the impression of comfort, but, without the provision of correct body positioning, can result in aggravating the discomfort which can be anticipated if a person is to remain improperly supported in substantially the same position for any period of time. Further, certain of these prior art devices are complicated in construction.

SUMMARY OF THE INVENTION

A primary object of the present invention is to provide maximum comfort to the user by maintaining proper sitting position during vehicle travel, work or other activity, through the provision of cushioned and anatomically correct support of the user's back.

It is a further object of the invention to be of orthopedic and/or therapeutic value to the user by providing resilient three-way support, vertical, lateral and upward, for the user's full back. Said cushioned multiple support of the back tends to reduce neuromuscular aggravation and other causes of physical discomfort, even pain, and any concomitant physical and/or mental fatigue.

Another important feature of the invention is its provision of three-way support concentrated in the area where it has been found in all research to be most needed: the lumbosacral. Wrap-around lateral support in the lumbosacral and lower thoracic regions and upwardly tending gentle pressure at spine base combine with the vertical pressure along the spine to provide increased comfort concentrated in, though not limited to, the user's lumbosacral region.

Another primary object of the back rest of the present invention is to provide freedom of movement to the upper torso and arms by means of the cut-away formation of the upper portion of the pad. The cut-away design frees the user's shoulder blades and thereby arms for necessary movement, and allows partial turning of the upper torso, all without loss of contact with the pad and thereby without reduction of support to the back during upper torso and arm movement.

An important result of making possible upper torso and arm movement through employment by vehicle drivers of the present back rest is an increase in vehicle travel safety. The freeing of the upper torso and arms for necessary driving movements facilitates efficient driving and thereby safety.

Yet another feature of the present invention is its one-size adaptability to persons of varied sizes, providing substantial support to a wide range of persons of varied heights and body types by means of its sinuous vertical and lateral curves as well as, in the preferred embodiment, its all-over flexibility. It is, further, an important object of the invention to achieve balance between support and cushioning of the back by means of the substance used to form the pad. Such a substance, being of open or closed cell polyurethane foam, preferably in densities ranging from ILD 20 pounds to ILD 25 pounds, is used to form the pad of the present invention. Said polyurethane foam in the prescribed range of densities is firm enough to automatically maintain equal supporting pressure on the particular contours of the user's body, yet resilient enough to provide unimpeded blood circulation.

Another important feature of the invention is to provide effective support and cushioning of the user's back regardless of the pitch or angle of the seat and the like to which it is applied.

It is still a further object of the present invention to provide a back support cushion which is simple of construction, consisting, in one embodiment, of a molded or pressed foam pad enclosed in a fabric casing, although other casing materials can be employed.

In one embodiment the portability of the pad is an additional feature, the pad being in the form of a separate cushion preferably having a planar surface which is placed against the seat-back and is coincident with or parallel to the sinuously curved surface which contacts the user's back.

In another form of the back rest, the pad is formed integrally with another structure, for example, the back rest of a seat.

The characteristics and advantages of the invention are further sufficiently referred to in connection with the following detailed description of the accompanying drawings, which represent one embodiment. After considering this example, skilled persons will understand that many variations may be made without departing from the principles disclosed, and I contemplate the employment of any structure, arrangements or modes of operation that are properly within the scope of the appended claims.

DESCRIPTION OF THE PREFERRED EMBODIMENT

The back support pad illustrated embodies a portable article which is designed, in one embodiment, to be placed against the back of a chair, carseat or other suitable seat. The pad has essentially a back, planar surface and a front surface sinuously curved laterally and vertically in a manner which will be hereinafter set forth.

The pad of the present invention is injection-molded with a self skinning reaction-in-mold closed-cell polyurethane foam and preferably having a grained skin to obviate slipping of the pad against the seat back. Suitable casing of the pad such as polyester cotton twill may also be used. If desired in other embodiments, features for removable interconnection with the seat to increase stability against the seat-back may be included, but are unnecessary for effective use of the back rest pad.

Figure 1:
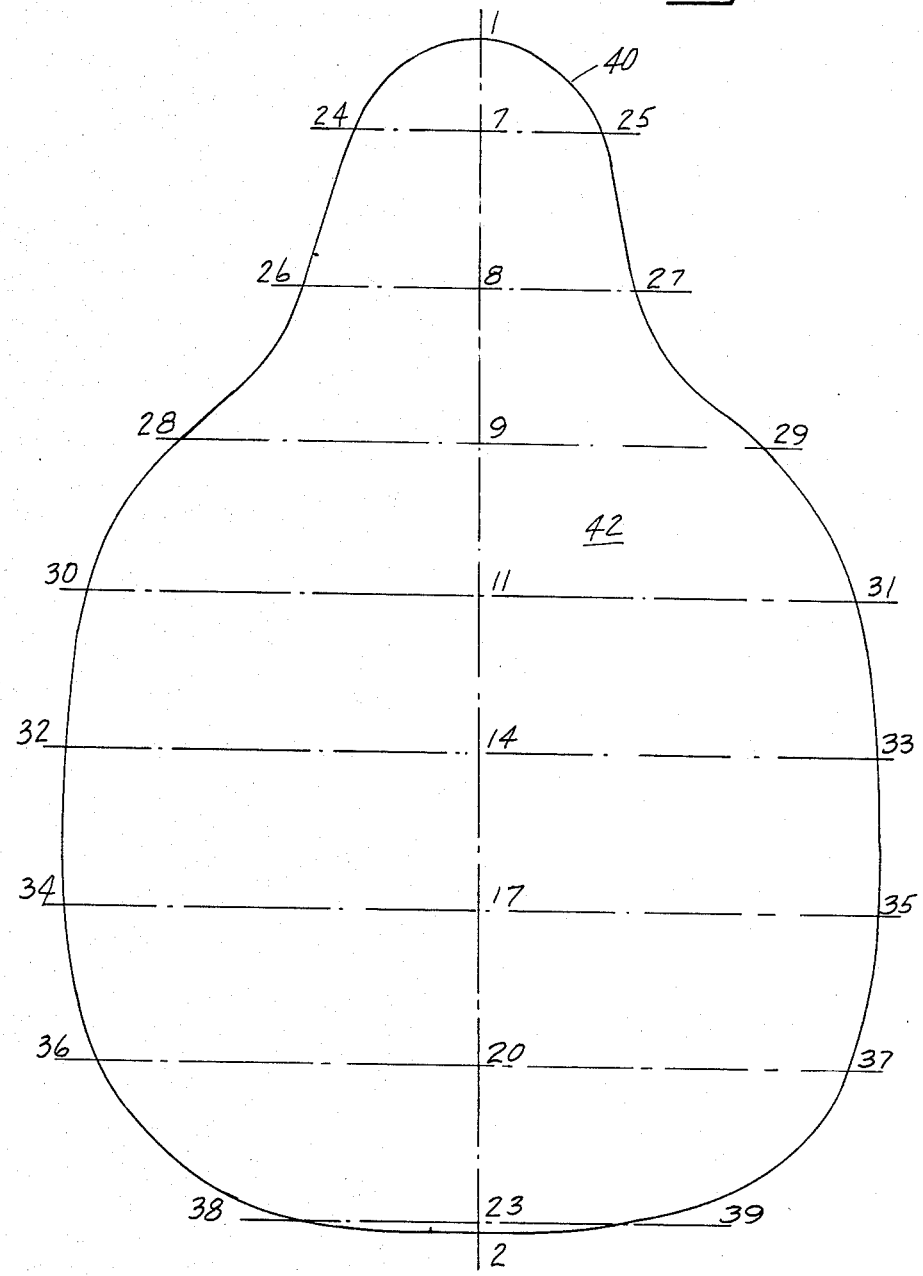
FIG. 1 is a frontal view of a back support pad constructed in accordance with the invention.

Referring to FIG. 1, there is shown a plan view of the invention in which the lower three-fifths, below line 28–29, of the pad's outermost boundary 40 is substantially rectangular in shape with curved corners, i.e., between 28–30, 29–31, 36–38, and 37–39, while the upper two-fifths of the outline 40 curves up inwardly from horizontal line 28–29 on each side to avoid the user's shoulder blades. Said upper section beginning at line 28–29 ends at top point 1, forming a slightly splayed inverted U-shape which in width along line 24–25 is approximately one-third the width of the widest horizontal span along line 32–33 of the lower rectangular shape, and is centered along vertical line 1–2 in relation to the rest of the planar figure.

Figure 2:
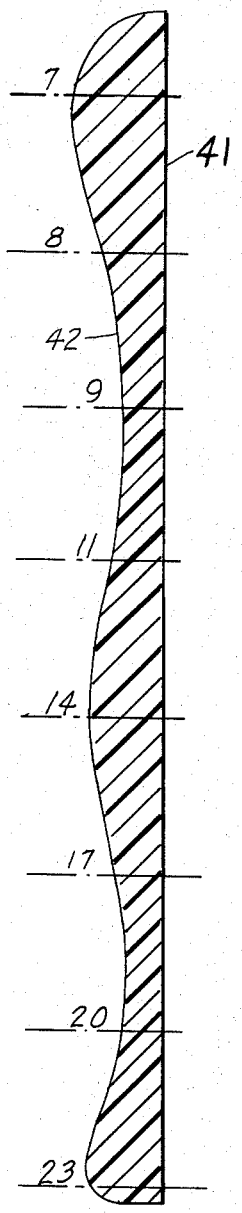
FIG. 2 a cross-sectional view taken along the vertical mid-plane 1–2 of the pad of FIG. 1.

In FIG. 2 there is shown a view of the sinuously curved front surface 42 and the planar back surface 41 of the back rest pad in cross-section at the vertical midplane 1–2. The supporting front surface of the pad has at the vertical midplane 1–2 a lower concavity 20, an upper concavity 9, and three convexities: the lowest near the location 23, the next higher and larger 14, and the highest, largest 7. Such concave and convex portions are intended to be disposed at certain positions with reference to the spinal column of the user. Thus the outermost portion of the convexity 23 is located at substantially the lower one-third of the sacrum, the deepest portion the concavity 20 is located at substantially the mid-point of the lumbar, the deepest portion of the concavity 9 is located at substantially the mid-point of the thoracic region, and the outermost portion of the convexity 7 is located at substantially the mid-section of the upper thoracic region.

Along the central plane 1–2, the front-to-back depth of the cushion may vary, for example, from about two inches at the maximum depth of the thoracic bulge or top mid-line convexity approximately at location 7, down to about one inch in the concavity between the thoracic and lumbar areas, up to about two inches again in the convexity of the lumbar area, approximately at location 14, down again to about $1\frac{1}{2}$ inches just above the coccyx bulge or lower convexity, and up to about two inches again in the coccyx convexity, approximately at the point 23.

Figure 3:
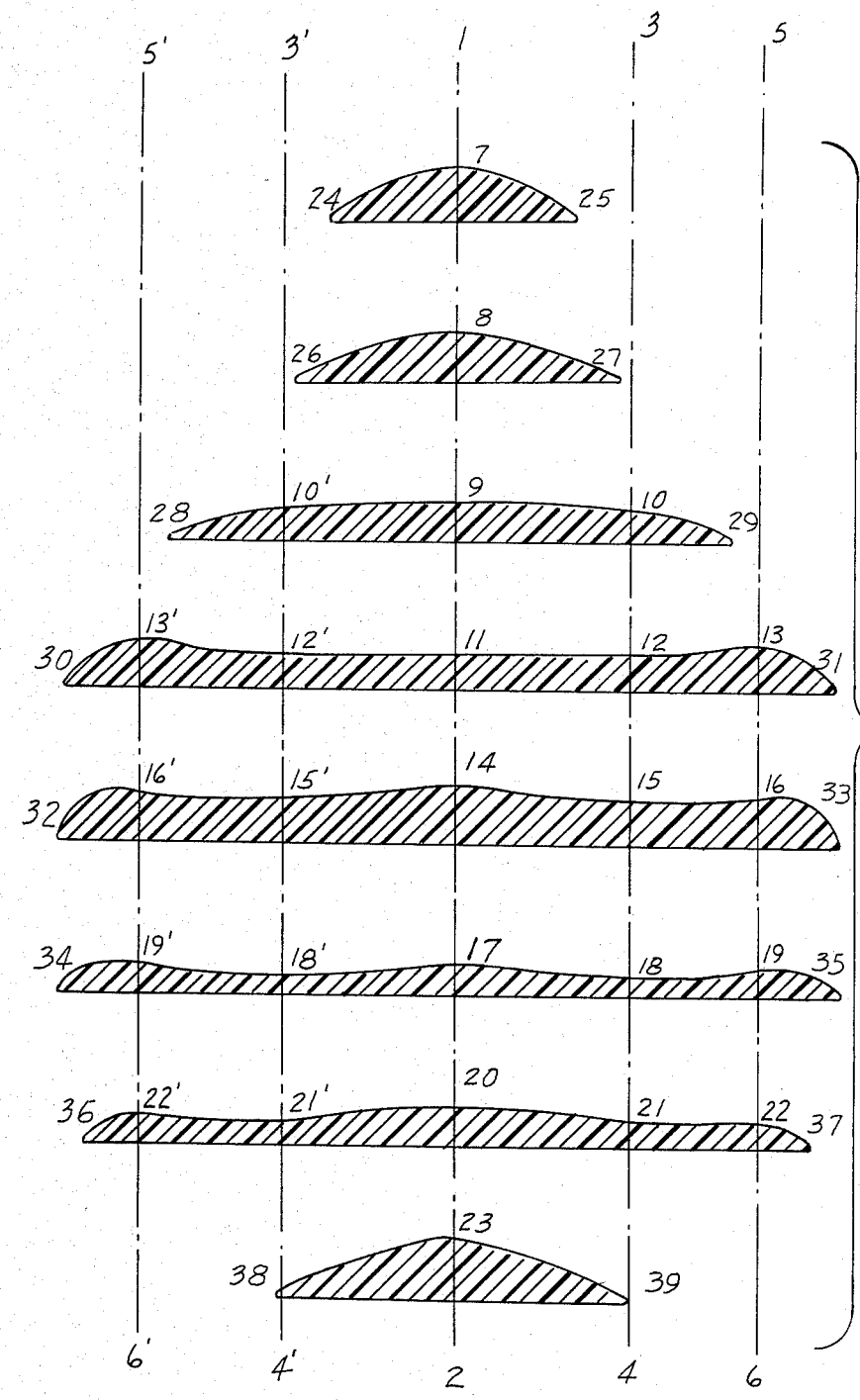
FIG. 3 is a series of cross sectional views taken along the horizontal planes 24–25, 26–27, 28–29, 30–31, 32–33, 34–35, 36–37, and 38–39 of the pad of FIG. 1.
Figure 4:
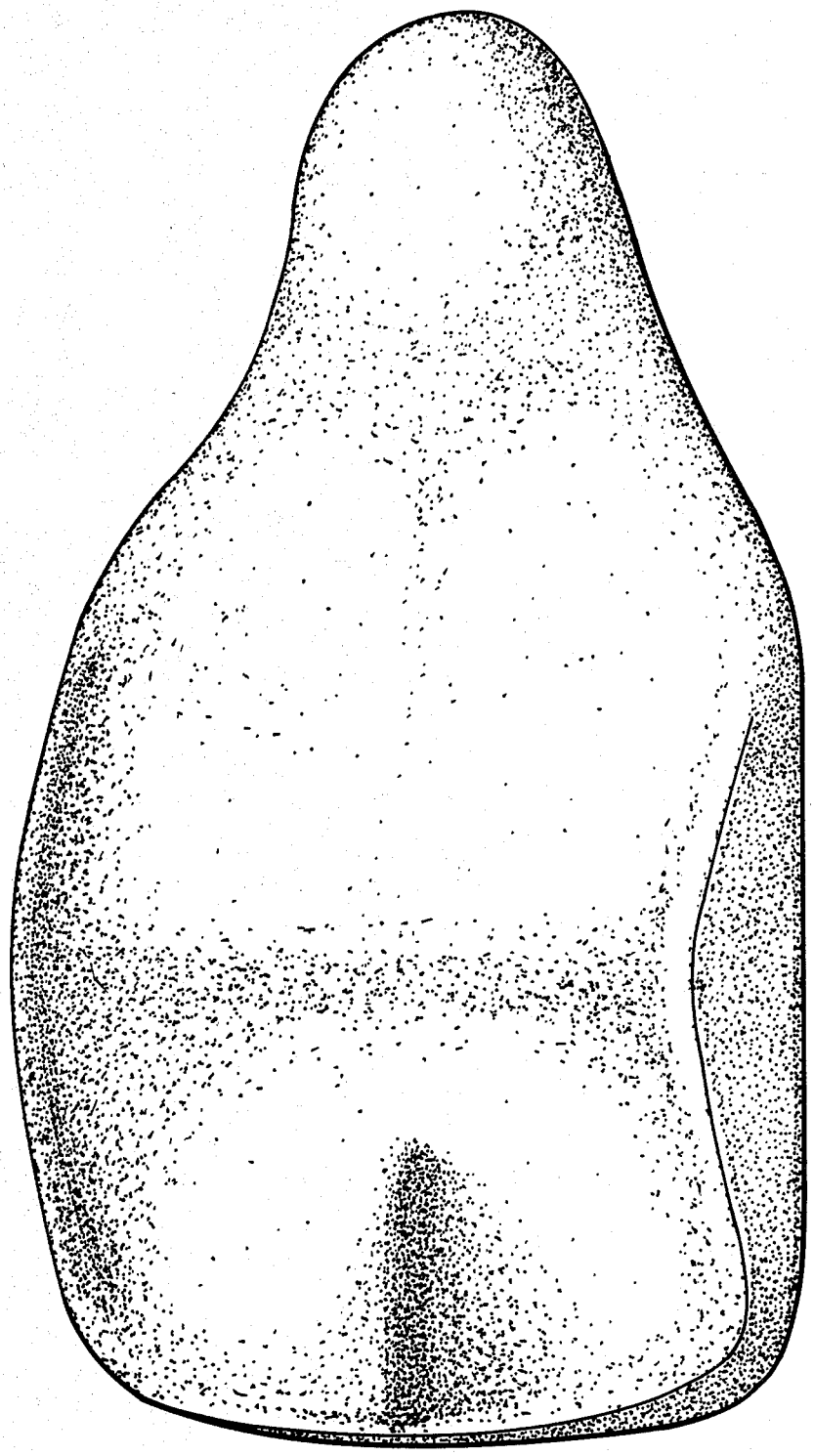
FIG. 4 is a perspective view of the back rest cushion of the invention.

In FIG. 3 are shown eight cross-sectional views of the back rest, delineating the lateral front surface curves as viewed in cross-section along the horizontal planes 24–25, 26–27, 28–29, 30–31, 32–33, 34–35, 36–37, and 38–39. The lateral wrap-around support to the lower thoracic, the lumbar and the upper sacral regions of the user's back is illustrated in FIG. 3 as occurring near said horizontal planes as the lateral concavities 15 and 15' and convexities 16 and 16' at substantially the upper lumbar, the lateral concavities 18 and 18' and convexities 19 and 19' at substantially the lower lumbar, and lateral concavities 21 and 21' with convexities 22 and 22' at the upper sacral.

In FIG. 3 some of the front-to-back depth measurements along the cross-sectional planes 3–4 and 3'–4' may be approximately at points 10 and 10', 1 inch, at 12 and 12', $1\frac{1}{4}$ inches, and 21 and 21', 1 inch. Similarly, the depth measurements along the cross-sectional planes 5–6 and 5'–6' may be approximately: at point 13 and 13', $1\frac{1}{4}$ inches, 16 and 16', $1\frac{7}{8}$ inches, 91 and 19', $1\frac{1}{4}$ inches, and 22 and 22', $1\frac{1}{8}$ inches. The two extreme vertical side convexities measure about 2 inches at their greatest depth along plane 32–33 and taper down to measure about $1\frac{1}{4}$ inches along plane 30–31 near points 13 and 13' and the same measurement along plane 34–35 near points 19 and 19'.

The overall height of the back rest, measured along the vertical midplane 1–2 at the planar back surface 41, is $23\frac{3}{4}$ inches. The width at the horizontal plane 32–33 is $15\frac{3}{4}$ inches.

The height of the top mid-line convexity 7, measured at the planar back 41 along mid-line plane 1–2, beginning at point 1 from edge 40 and ending at point 9, is $8\frac{1}{2}$ inches. Similarly measured, the height of the middle convexity beginning at point 9 and ending at point 20, is $12\frac{1}{4}$ inches. Similarly, beginning at point 20 and measuring downward to point 2, the height of the lowest convexity on the vertical mid-plane 1–2 is 3 inches.

The vertical distance between the upper vertical mid-line concavity 9 at lateral plane 28–29 and the high point of the convexity at point 14 is about $6\frac{1}{4}$ inches. The lower two side vertical concavities beginning at plane 38–39, or $\frac{1}{2}$ inch up the edge 40 at points 38 and 39, and ending at plane 32–33 at points 15' and 15, are $8\frac{1}{2}$ inches in height.

The height of the two side vertical convexities, measuring from approximately the lateral mid-planes 30–31 to 36–37 along vertical planes 5–6 and 5'–6', is 9 inches.

The horizontal width of the top mid-line convexity 7 along plane 24–25 is $5\frac{1}{2}$ inches, that of middle convexity 14 along plane 32–33 is $15\frac{1}{2}$ inches, and that of the lower mid-line convexity 23 along plane 38–39 is $5\frac{1}{2}$ inches.

The horizontal width of the upper concavity 9 along plane 28–29 is $13\frac{1}{2}$ inches and the width spanning the lower two concavities 15 and 15' along plane 32–33 is 9 inches.

The width from the outside edge 40 inward to the high point of the two side vertical convexities, is 1½ inches.

In the preferred embodiment, an injection mold, or reaction-in-mold process, using closed cell liquid foamed plastics, may be used to manufacture the pad of the present invention. This method allows the possibility of forming a self-skin that can result from utilization of said process.

Another method of manufacture consists in cold-pressing a pre-cut uni-thickness slab of flexible open-cell foamed plastic, preferably polyurethane foam in densities ranging from ILD 20 to ILD 25, measuring 2½ inches by 17 inches by 25 inches and cut to the overall outline of the back rest, into a wooden mold consisting in a hollowed out shape corresponding exactly to the sinuously curved front surface of the back rest, and then slicing horizontally flush with the edge of the mold. The pad is then removed fully formed from the mold, needing no curing process to set its shape. The nature of the polyurethane foam is such that the form of the mold after release of the pad is permanently and exactly reproduced in the foam. After prolonged use the pad will mold itself very slightly to the contours of the user, changing not more than 20 percent in shape. Said change does not substantially reduce its effectiveness to its owner nor to other users. The process so described is called form-press and cut.

For esthetic presentation the pad may be encased in a cover. For user-comfort the cover is preferably fabric, therefore porous. For purposes of stability against the seat-back this cover or casing may be fabric of a non-slip variety, such as polyester-cotton twill. The cover, consisting in a front and side piece, both in the preferred form of fabric cut on the bias, and a back piece cut on the horizontal lay, is joined together by sewing or other interconnecting means, part of which may be a zipper for ease of removeability and cleaning of the cover. The pad is slipped into the casing through an opening, which, for purposes of comfort, stability against the seat, ease of insertion, and esthetic presentation, preferably zippered and located at the lower, horizontal edge of the pad back 41. The opening may in alternate embodiments be closed by any other suitable interconnecting means such as sewing or VELCRO, or a tuck-in flap. Additionally, four small flat fabric-covered buttons preferably are installed at points 12, 12', 18 and 18' for purposes of aesthetic presentation.

In another embodiment, a rigid backing of plywood or plastic or other suitable substance can be affixed to the pad back 41 to insure effective support thereby in cases where the seat-back to which the pad is applied is badly deteriorated or otherwise unusually shaped.

Additional features for removable interconnection with the seat, such as straps having balls on their ends for insertion between seat-back and seat, or VELCRO fasteners or other suitable interconnecting means, may be added to the pad of the present invention in other embodiments.

On application the back rest pad of the present invention has the following advantages: The three-way positive supporting yet cushioned pressure on the user's full back during sitting may help prevent and ease muscular tension or stiffness, bodily pain, physical and mental fatigue, as well as preclude functional impairment of internal organs and/or hampered breathing. The first such support, achieved by means of the sinuous resilient vertical protrusions, provides beneficial vertical spinal support, especially in the mid-lumbar region where the pad is thickest to provide greatest cushioning at a point of greatest load, from coccyx to upper thoracic vertebrae three to five, depending on the height of the user. The second means of cushioned positive support, provided by means of the wrap-around effect in the lumbar and lower thoracic regions, tends to reduce fatigue and tension in those areas that might be caused by laterally imposed loads, especially during the motion of vehicle travel, and to preclude a tendency of the back to curve sideways due to fatigue and the tiring of supporting muscles, which preclusion assures proper sitting position and therefore such benefits as freedom of breathing, proper functioning of internal organs, and reduction of neuromuscular aggravation. The third said positive cushioned support, achieved by the protrusion of the lower section of the pad which fits into the buttocks cleavage, maintains thereby gentle upwardly tending support at the coccyx to the lumbar sacral region as well as protection and support of the coccyx and sacrum. Additionally, said lower protrusion prevents lateral motion of the coccyx, which stability, again especially during vehicle travel, provides particular comfort to the user's coccyx and sacral regions.

The tapered cut-away formation of the upper portion of the back rest pad gives maximum freedom of movement of the user's scapulae and arms as well as of upper torso turning, particularly advantageous while driving. Such freedom of movement is achieved by preventing contact of the sharp inner corner, or inferior angle, of the shoulder blade, or scapula, with the seat-back, even though the spine, lower thoracic, lumbar sacral, and coccyx, of the user simultaneously remain supported by contact with the pad. Further, the advantageous freedom of movement provided by the cut-away design of the pad tends to increase driving safety by increasing driver efficiency and comfort during vehicle travel. Additionally, driving safety is increased due to the thoroughness of the three-way, full back, resilient support afforded the user while driving, which highly effective support tends to preclude and/or reduce physical and mental fatigue during driving activities.

Another advantage of the back rest pad of the present invention is its remarkable adaptability to persons of widely varied sizes and body types due to its sinuous vertical and lateral curves, to its cut-away design in the scapula area and, in the preferred embodiment, to its over-all flexibility. The pad works equally well for persons of varied spine lengths, being effective whether reaching up to the third thoracic vertebra, or, for taller persons, to merely the fourth, fifth, or even sixth thoracic vertebra. The very gradual nature of the vertical and lateral curves combined with the flexibility of the pad cause its basic supporting protrusions and wrap-around lateral curves to adapt sufficiently to persons of quite varied spine lengths and body types. The cut-away design which eliminates any contact of pad with the large scapula area precludes any necessity of size variation which might be concomitant upon varied shoulder blade sizes. Additionally, large variations in buttock size can be accommodated due to the hollowed out basic shape of the lower two twin concavities either side of the coccyx area mid-line vertical convexity, which basic shape will alter to curve around almost any buttock size due to the flexible nature of the pad material and con- struction.

While a support pad in the form of a separate cushion has been described, it will be appreciated that the pad could be formed integrally with another structure, for example, the back rest of an aircraft seat.

The invention and its other attendant advantages will be understood from the foregoing description and it will be apparent that various changes may be made in the form, construction and arrangement of the parts without departing from the spirit or scope thereof or sacrificing its material advantages, the arrangement hereinbefore described being merely by way of example and I do not wish to be restricted to the specific form shown or uses mentioned except as defined in the accompanying claims.

I claim:

1. A therapeutic back support comprising:

a unitary cushion of resilient material, having a forward back engaging side, said cushion having a lower end adapted to rest on a support surface for a seated person and having an upper end extending above the thoracic vertebrae, said cushion having a width about equal to the width of a human back and being symmetrical about a vertical central plane, the back engaging side of said cushion having merging concave and convex surfaces, said cushion being formed to a first convex surface adjacent to the lower end and centrally thereof for abutting the coccyx of the person and having concave surfaces laterally outwardly of said first convex surface, merging with the first convex surface and positioned for receiving the upper buttocks of the seated person, at approximately a lower-central location the cushion being formed with a second convex surface positioned to abut the lumbosacral region of the person's spine across the lower back and spaced from the first convex surface with a concave surface interposed therebetween, the upper end of the cushion being formed with a central third convex surface for abutting the thoracic region of the person's spine and spaced above the second convex portion by a merging concave surface, and the cushion being cut away to left and right of the central third convex surface to provide open space to freely accommodate movement of the upper torso, arms and shoulder blades of the seated person.

2. A cushion according to claim 1, wherein upper side edges of the cushion are formed into upwardly directed convex curves and connected to vertical side edges of the cushion by elongated ogee curves to provide outwardly and upwardly directed curving concave surfaces forming spaes outwardly of said ogee curves registering with the scapulae of the seated person.

3. A back rest cushion formed of resilient material for placing on a seat or chair having seat and back portions, for providing comfort and therapeutic benefits to a seated person whose back is engaged against the back rest cushion, comprising:

a lumbar support protruding forward as a convex area on the forward side of the cushion, positioned to engage the lumbosacral region of the seated person's back;

a thoracic support positioned centrally at the upper end of the cushion, protruding forward as a convex portion spaced above the lumar support with a concave area between them, the thoracic support being positioned to engage the thoracic region of the person's spine; and the cushion being cut away to the left and right of the thoracic support, leaving open spaces to accommodate free movement of the upper torso, arms and shoulder blades of the seated person.

4. The back rest cushion of claim 3, further including a coccyx support positioned centrally at the lower end of the cushion, protruding obliquely downwardly and forwardly as a convex portion located so as to engage the coccyx in the cleavage between the upper buttocks of the seated person, and with concave portions of the cushion laterally outwardly on either side of the coccyx support positioned for receiving the upper buttocks of the seated person, whereby the coccyx support provides support for the coccyx and also for the lumbosacral region above, and further provides lateral stability for the coccyx tending to prevent lateral movement.

5. The back rest cushion of claim 3, wherein the cushion is shaped generally rectangularly through most of its height, above the lumbar support and up to about the height of the concave area between the lumbar support and the thoracic support, with a generally horizontal bottom edge and generally vertical side edges and curving corners, and then curves inwardly and upwardly where it is cut away to the left and right of the thoracic support, with S-curves leading to a rounded upper end.

6. The back rest cushion of claim 3, further including a cover encasing the cushion, whereby the cushion is substantially prevented from side-to-side slipping when used on a vehicle seat.

* * * * *